US009682549B2

(12) United States Patent
Yamaguchi et al.

(10) Patent No.: US 9,682,549 B2
(45) Date of Patent: Jun. 20, 2017

(54) ELECTRONIC DEVICE, LIQUID EJECTING HEAD, AND METHOD OF MANUFACTURING ELECTRONIC DEVICE

(71) Applicant: SEIKO EPSON CORPORATION, Tokyo (JP)

(72) Inventors: Haruo Yamaguchi, Chino (JP); Tomoyoshi Saito, Chino (JP); Masashi Yoshiike, Chino (JP); Yoshihide Matsuo, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/206,407

(22) Filed: Jul. 11, 2016

(65) Prior Publication Data

US 2017/0028714 A1 Feb. 2, 2017

(30) Foreign Application Priority Data

Jul. 30, 2015 (JP) ..... 2015-150426

(51) Int. Cl.

| | |
|---|---|
| ***B41J 29/38*** | (2006.01) |
| ***B41J 2/045*** | (2006.01) |
| ***B41J 2/16*** | (2006.01) |

(52) U.S. Cl.

CPC ..... *B41J 2/04581* (2013.01); *B41J 2/04541* (2013.01); *B41J 2/1607* (2013.01); *B41J 2/1623* (2013.01); *B41J 2202/13* (2013.01); *B41J 2202/22* (2013.01)

(58) Field of Classification Search

None

See application file for complete search history.

(56) References Cited

U.S. PATENT DOCUMENTS

2003/0063137 A1* 4/2003 Kamei ..... B41J 2/161 346/70

FOREIGN PATENT DOCUMENTS

| | | |
|---|---|---|
| JP | 2002-086724 A | 3/2002 |
| JP | 2014-051008 A | 3/2014 |

* cited by examiner

*Primary Examiner* — Matthew Luu
*Assistant Examiner* — Tracey McMillion
(74) *Attorney, Agent, or Firm* — Workman Nydegger

(57) ABSTRACT

An electronic device includes a first substrate that has a drive region in a first surface, and a second substrate that has a second surface that is joined to the first surface by a joining resin portion composed of a photosensitive resin. In the electronic device, a space that houses the drive region is defined between the first surface and the second surface by the joining resin portion, and a joining surface of the joining resin portion joined to the first surface is smaller than a joining surface of the joining resin portion joined to the second surface.

8 Claims, 5 Drawing Sheets

ELECTRONIC DEVICE, LIQUID EJECTING HEAD, AND METHOD OF MANUFACTURING ELECTRONIC DEVICE

CROSS-REFERENCE TO RELATED APPLICATIONS

The present application claims priority to Japanese Patent Application No. 2015-150426 filed on Jul. 30, 2015, which is hereby incorporated by reference in its entirety.

BACKGROUND

1. Technical Field

The present invention relates to an electronic device that has a multi-layer body in which a first substrate and a second substrate are joined to each other by a joining resin portion composed of a photosensitive resin, a liquid ejecting head, and a method of manufacturing the electronic device.

2. Related Art

The electronic device is a device that is provided with driver elements such as piezoelectric elements or the like that deform by application of a voltage and has been applied to various liquid ejecting apparatuses and pressure/vibration sensors and the like. For example, in a liquid ejecting apparatus, various liquids are ejected from a liquid ejecting head that uses the electronic device. As liquid ejecting apparatuses, for example, there exist image recording devices such as ink jet printers, ink jet plotters and the like, however, recently, liquid ejecting heads have been applied to various manufacturing devices by utilizing their advantage of being able to make a minute amount of liquid precisely land onto a designated position. For example, liquid ejecting heads have been applied to display manufacturing devices that manufacture color filters of liquid crystal displays and the like, electrode forming devices that form electrodes of organic electroluminescence (EL) displays, field emission displays (FEDs) and the like, and chip manufacturing devices that manufacture biochips. In addition, a recording head for image recording devices ejects liquid ink, and a color material ejection head for display manufacturing devices ejects solutions of individual color materials of red (R), green (G), and blue (B). Moreover, an electrode material ejecting head for electrode forming devices ejects a liquid electrode material and a bioorganic matter ejecting head for chip manufacturing devices ejects a solution of bioorganic matter.

The above-described liquid ejecting heads include an electronic device in which a pressure-chamber-forming substrate formed of pressure chambers that communicate with nozzles, piezoelectric elements (a type of driver element) that cause a change in pressure in the liquid inside the pressure chambers, a sealing plate (also called a protective substrate) that is arranged so as to be separated at a distance from the piezoelectric elements, and the like are stacked. An electronic device in which such substrates are bonded together so as to form a space therebetween that houses a piezoelectric element has been proposed (for example, JP-A-2002-86724). In addition, in a semiconductor package in micro-electro-mechanical systems (MEMS) such as various sensors, a structure is adopted in which substrates are stacked and joined by using joining resin portions in order to achieve densification and size reduction of wiring. The joining resin portions are patterned in a predetermined shape on a substrate through a photolithography process, that is, through processes such as coating onto a substrate, pre-baking (pre-curing), exposure, development and post-baking (main-curing).

In recent years, size reduction and densification of liquid ejecting heads has progressed, and it has become difficult to secure a joining width (joining surface of adhesive) necessary to join substrates to each other. In this regard, in the invention disclosed in JP-A-2002-86724, on the side of the substrate (the (110)-oriented silicon substrate) that is the side joined to the other substrate having a piezoelectric element, a dividing wall that defines a space that houses the piezoelectric element, is formed so as to become triangular in cross section by performing anisotropic etching in such a manner that the width of the dividing wall becomes narrower toward the piezoelectric element side. The leading end of the dividing wall is pushed against a highly elastic layer and fixed thereto by pressure-joining. Consequently, the dividing wall does not interfere with the piezoelectric element and a space that houses the piezoelectric element is defined.

However, in the above-described configuration, even though a dividing wall is formed by performing anisotropic etching on the silicon substrate, there is a problem in that the degree of freedom for the dimensions and shape of the dividing wall are limited and further size reduction and densification of the liquid ejecting head and the electronic device are difficult.

SUMMARY

An advantage of some aspects of the invention is that an electronic device capable of achieving both size reduction and high adhesive reliability, a liquid ejecting head and a method of manufacturing the electronic device are provided.

First Aspect

An electronic device of this aspect of the invention includes a first substrate that has a drive region in a first surface and a second substrate that has a second surface that is joined to the first surface by a joining resin portion composed of a photosensitive resin, in which a space that houses the drive region is defined between the first surface and the second surface by the joining resin portion, and a joining surface of the joining resin portion joined to the first surface is smaller than a joining surface of the joining resin portion joined to the second surface.

According to the configuration of the first aspect, it is possible to achieve both the size reduction and high adhesive reliability of the electronic device that has a multi-layer body in which the first substrate and the second substrate are joined to each other by the joining resin portion. That is, by making the joining surfaces of the first substrate including the drive region and the joining resin portion smaller than the joining surfaces of the second substrate and the joining resin portion, it is possible to arrange the joining resin portion without interfering with the drive region or the like even if space on the first substrate is limited. Consequently, it is possible to achieve size reduction and high densification of the electronic device. Moreover, because the joining surface of the joining resin portion joined to the second surface is larger than the joining surface on the first substrate side, it is possible to secure adhesive reliability. Furthermore, because a space is defined between the first substrate and the second substrate by the joining resin portion, it is possible to flexibly adopt various types of layouts of the drive region of the electronic device.

Second Aspect

In the configuration of the first aspect, it is desirable that the joining resin portion have a trapezoidal shape in which, in a cross section obtained in a short side direction, a side of the first surface is a narrow side and a side of the second surface is a long side.

According to a configuration of a second aspect, by making the joining resin portion have a trapezoidal shape in which, in a cross section of the joining resin portion, a side of the first surface is a narrow side and a side of the second surface is a long side, the joining surface of the joining resin portion joined to the first surface is smaller than the joining surface of the joining resin portion joined to the second surface.

Third Aspect

Moreover, in relation to the configuration of the first aspect or the second aspect, it is desirable that the thickness of the second substrate be smaller than the thickness of the first substrate.

According to a configuration of a third aspect, it is possible to realize a structure in which the joining surface of the joining resin portion joined to the first surface is smaller than the joining surface of the joining resin portion joined to the second surface without any additional processes, that is, it is possible to realize a structure in which the joining surface of the joining resin portion joined to the second surface is larger than the joining surface of the joining resin portion joined to the first surface. That is, by the thickness of the second substrate being smaller than the thickness of the first substrate, it is possible to increase the amount of heat transferred from the second substrate to the joining resin portion more than the amount of heat transferred from the first substrate to the joining resin portion in the process of curing the joining resin portion while providing a force (load) and heat via the first substrate and the second substrate. Consequently, it becomes easier for the joining resin portion to deform close to the second substrate side when softened temporarily in the process for curing the joining resin portion, and, as a result, the joining surface of the joining resin portion joined to the second surface becomes larger than the joining surface of the joining resin portion joined to the first surface.

Fourth Aspect

Moreover, a liquid ejecting head of this aspect of the invention includes the electronic device of any one of the first to third aspects, in which, by driving the drive region by using a piezoelectric element, a pressure change is produced in a liquid in a pressure chamber formed in the first substrate and the liquid is caused to be ejected from a nozzle via the pressure chamber by using the pressure change.

According to this configuration, it is possible to provide a liquid ejecting head having a smaller size and higher reliability by installing the electronic device capable of achieving both size reduction and high adhesive reliability.

Fifth Aspect

A method of manufacturing an electronic device of this aspect of the invention is a method of manufacturing an electronic device that includes a first substrate that has a drive region in a first surface and a second substrate that has a second surface that is joined to the first surface by a joining resin portion composed of a photosensitive resin, in which a space that houses the drive region is defined between the first surface and the second surface by the joining resin portion. The method includes applying a photosensitive resin material that becomes the joining resin portion on the first surface of the first substrate, pre-curing the photosensitive resin material by heating, patterning the photosensitive resin material through exposure and development, joining the first substrate and the second substrate while the photosensitive resin material is interposed between the first surface and the second surface, and main-curing the joining resin portion by heating while a force is maintained in a direction in which the first substrate and the second substrate press the joining resin portion, in which an amount of heat transferred from the second substrate to the joining resin portion during the main-curing is larger than an amount of heat transferred from the first substrate to the joining resin portion.

According to a method of a fifth aspect, because the amount of heat transferred from the second substrate to the joining resin portion during main-curing is larger than the amount of heat transferred from the first substrate to the joining resin portion, it becomes easier for the joining resin portion to deform close to the second substrate side when softened temporarily in the curing of the joining resin portion, and, as a result, the joining surface of the joining resin portion joined to the second surface is larger than the joining surface of the joining resin portion joined to the first surface. That is, by making the joining surfaces of the first substrate including the drive region and the joining resin portion smaller than the joining surfaces of the second substrate and the joining resin portion, it is possible to arrange the joining resin portion without interfering with the drive region or the like even if space on the first substrate is limited. Consequently, it becomes possible for the structures and joining resin portion on the substrates to have a high densification and it is possible to achieve size reduction and high densification of the electronic device. Moreover, because the joining surface of the joining resin portion joined to the second surface is larger than the joining surface on the first substrate side, it is possible to secure adhesive reliability.

Sixth Aspect

In the method of the fifth aspect, it is desirable that the applying include a first application of a first photosensitive resin material that becomes the joining resin portion to the first surface and a second application of a second photosensitive resin material that becomes the joining resin portion to the first photosensitive resin material so as to be stacked on the first photosensitive resin material, and that the pre-curing include a first pre-curing of the first photosensitive resin material after the first application has been performed and a second pre-curing of the first photosensitive resin material and the second photosensitive resin material after the second application has been performed.

According to the method of the sixth aspect, the degree of curing of a first photosensitive resin material on the first substrate side is, by performing the first pre-curing and the second pre-curing, increased so as to be higher than that of the second photosensitive resin material on the second substrate side at the time of the main-curing. By doing this, deformation is suppressed when a force (load) and heat are applied in the main-curing and the first photosensitive resin material is formed precisely at a predetermined position on the first substrate. As a result, it is possible to make the electronic device smaller and finer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, modes for carrying out the invention will be described with reference to the accompanying drawings. The embodiment described below is a preferred embodiment of the invention, and even though various limitations are imposed, the scope of the invention is not intended to be limited to these limitations unless there is a particular description that limits the invention in the following description. Moreover, hereinafter, an ink jet printer (hereinafter, printer), which is one type of liquid ejecting apparatus mounted with an ink jet recording head (hereinafter, recording head), which is one type of liquid ejecting head including an electronic device according to the invention, will be described as an example.

Figure 1:
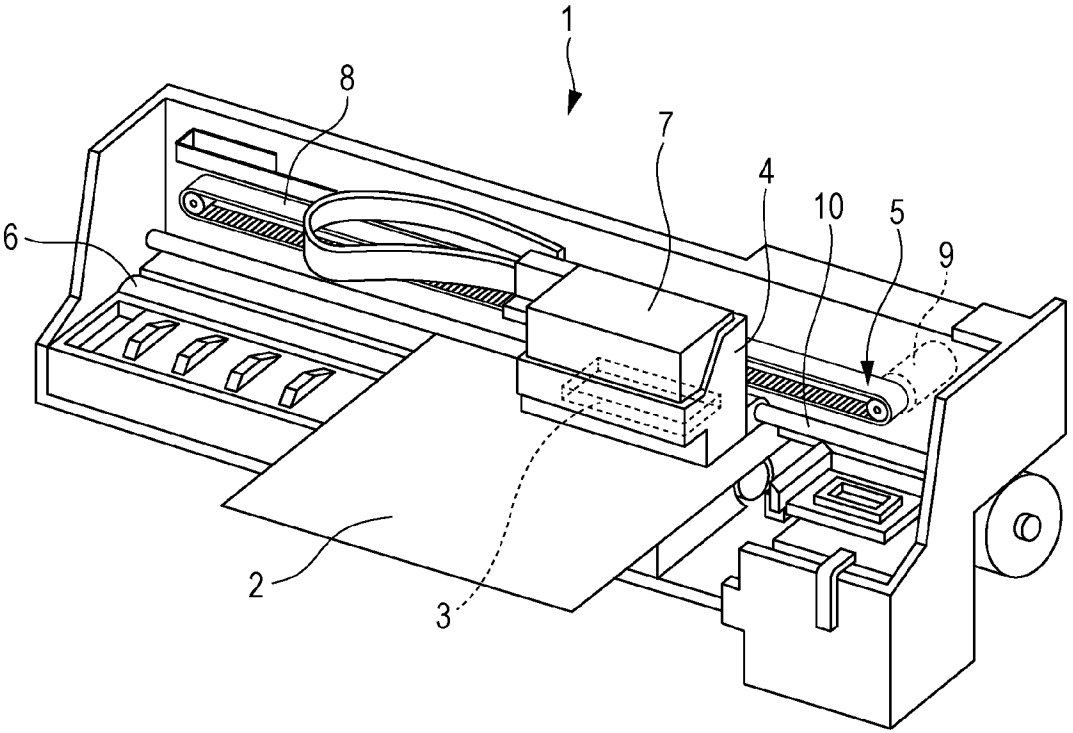
FIG. 1 is a perspective diagram illustrating a structure of a printer.

The structure of a printer 1 will be described with reference to FIG. 1. The printer 1 is an apparatus that performs recording of an image or the like by ejecting ink (a type of liquid) onto a surface of a recording medium 2 such as recording paper. The printer 1 has a recording head 3, a carriage 4 to which the recording head 3 is attached, a carriage moving mechanism 5 that moves the carriage 4 in a main scanning direction, a transport mechanism 6 that transports the recording medium 2 in a sub-scanning direction, and the like. Here, the above-described ink is stored in an ink cartridge 7 that functions as a liquid supply source. The ink cartridge 7 is detachably attached to the recording head 3. Further, the ink cartridge is arranged in the body of the printer, and has a structure that enables the recording head to be supplied with ink from the ink cartridge by an ink supply tube.

The carriage moving mechanism 5 has a timing belt 8. The timing belt 8 is driven by a pulse motor 9 such as a DC motor. Therefore, when the pulse motor 9 operates, the carriage 4 is guided by a guide rod 10 that is installed in the printer 1 and reciprocates in the main scanning direction (the width direction of the recording medium 2). The position of the carriage 4 in the main scanning direction is detected by a linear encoder (not illustrated). The linear encoder transmits a detection signal, that is, an encoder pulse, to a control unit of the printer 1.

Figure 2:
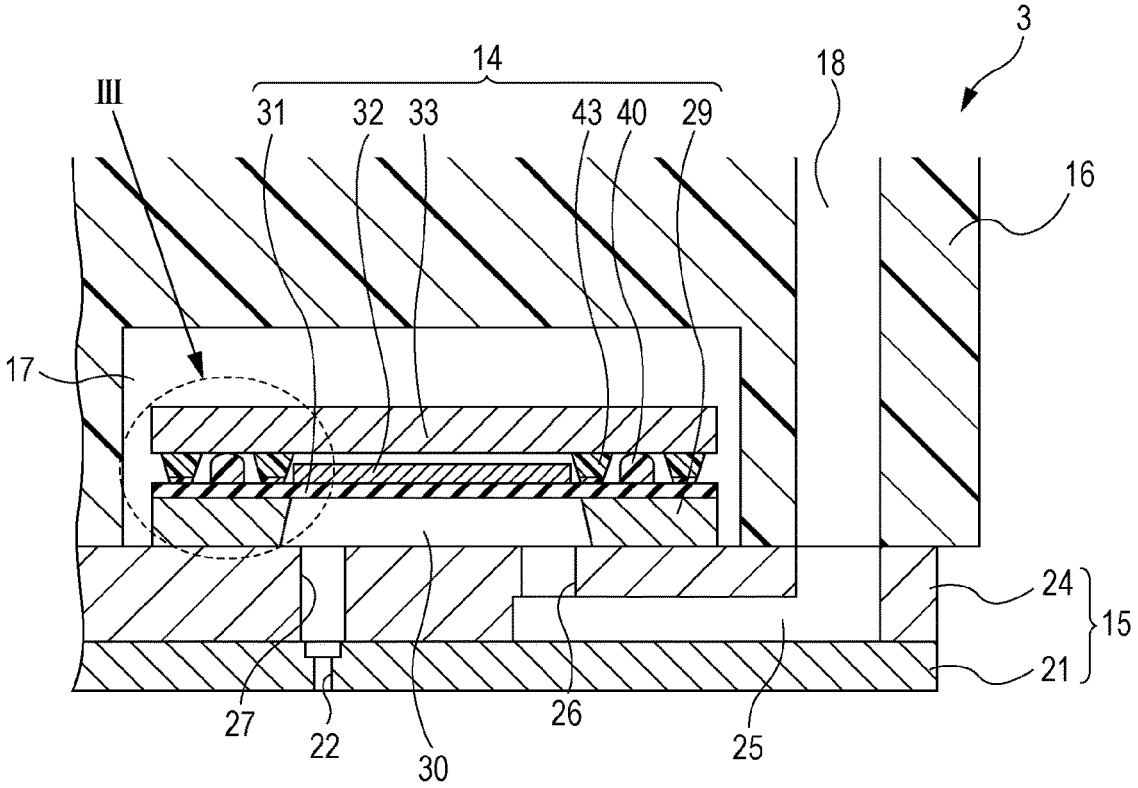
FIG. 2 is a cross-sectional diagram illustrating a structure of a recording head.
Figure 3:
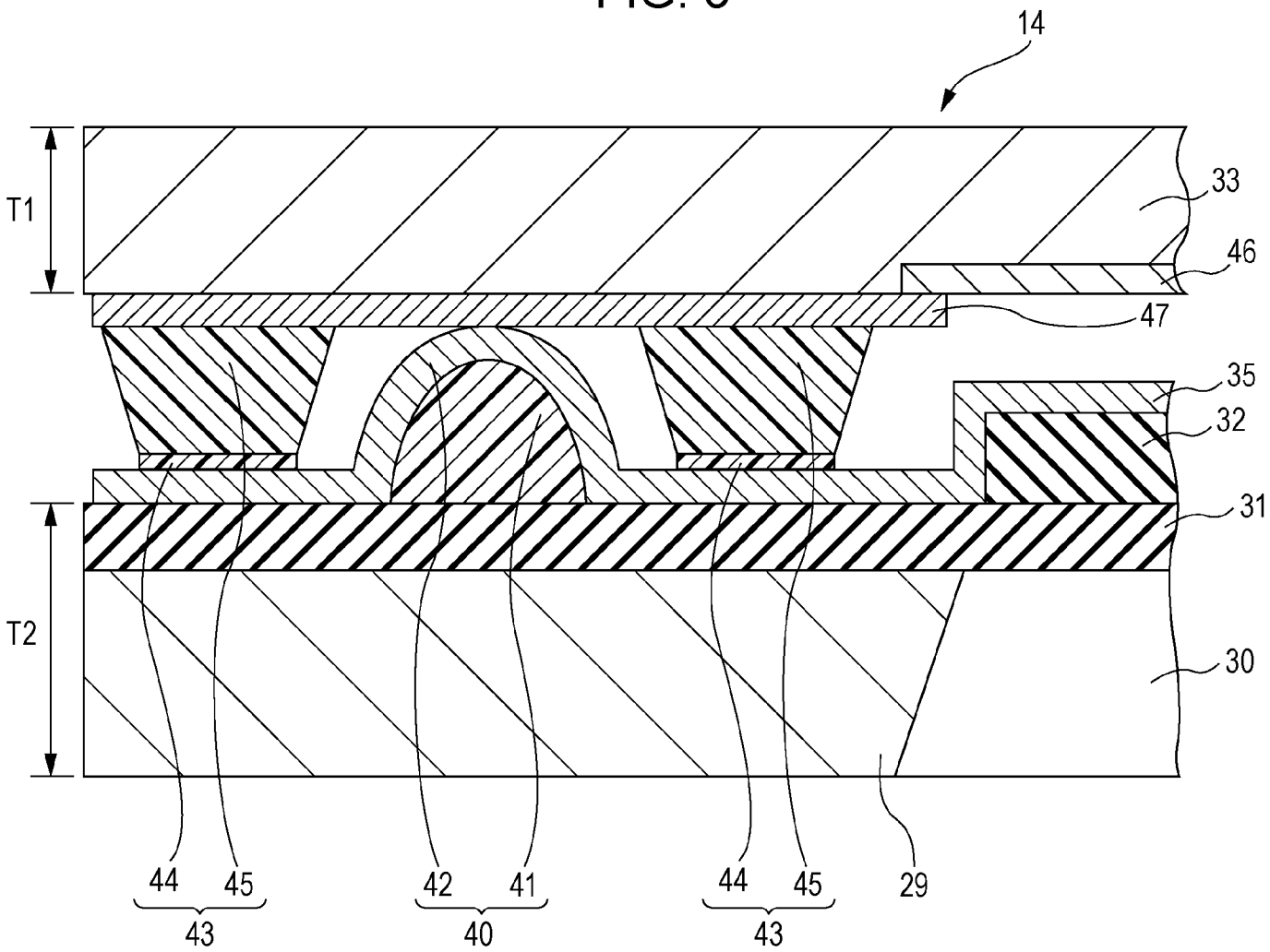
FIG. 3 is an enlarged cross-sectional diagram of a main part of an electronic device.

Next, a description of the recording head 3 will be given. FIG. 2 is a cross-sectional diagram depicting the structure of the recording head 3. FIG. 3 is an enlarged view of a region III illustrated in FIG. 2, and is an enlarged cross-sectional diagram illustrating the main part of an electronic device 14 incorporated in the recording head 3. The recording head 3 of this embodiment is, as shown in FIG. 2, attached to a head case 16 in which the electronic device 14 and a flow path unit 15 are stacked. Moreover, for convenience, the stacking direction of individual members is described as the vertical direction.

The head case 16 is a box shape member composed of a synthetic resin, and ink introduction channels 18 that supply ink to pressure chambers 30 are formed therein so as to extend in the height direction of the case. The ink introduction channels 18 communicate with common liquid chambers 25 of the flow path unit 15 and are flow paths that supply ink from the ink cartridge 7 to the common liquid chambers 25. Moreover, a housing space 17 that has a hollow box shape is formed on the lower surface side of the head case 16 halfway up in the height direction of the head case 16 from the bottom surface thereof. When the flow path unit 15 to be described later is joined to the lower surface of the head case 16 while being positioned on the lower surface of the head case 16, the electronic device 14 (a pressure-chamber-forming substrate 29, a sealing plate 33, and the like) stacked on top of a communication substrate 24 is formed so as to be housed within the housing space 17.

The flow path unit 15 to be joined to the lower surface of the head case 16 includes the communication substrate 24 and a nozzle plate 21. The communication substrate 24 of this embodiment is formed of a silicon single-crystal substrate. In the communication substrate 24, as illustrated in FIG. 2, the common liquid chambers 25 that communicate with the ink introduction channels 18 and that store ink common to the pressure chambers 30, and separate communication paths 26 that separately supply ink from the ink introduction channels 18 along the common liquid chambers 25 to the pressure chambers 30 respectively are formed by etching. The common liquid chambers 25 are long spaces that are arranged along the nozzle row direction (direction parallel to the pressure chambers 30). The separate communication paths 26 are formed along a direction parallel to the pressure chambers 30 so as to correspond to the pressure chambers 30. The separate communication paths 26 each communicate with an end portion of a corresponding one of the pressure chambers 30 on one side of the pressure chamber 30 in the length direction in a state where the communication substrate 24 and the pressure-chamber-forming substrate 29 are joined to each other.

Moreover, nozzle communication paths 27 that penetrate through the communication substrate 24 in the thickness direction are formed at positions corresponding to individual ones of nozzles 22 of the communication substrate 24. That is, the nozzle communication paths 27 are formed along the nozzle row direction of corresponding nozzle rows. The pressure chambers 30 and the nozzles 22 communicate with each other through the nozzle communication paths 27. The nozzle communication paths 27 of this embodiment each communicate with an end portion of a corresponding one of the pressure chambers 30 on the other side of the pressure chamber 30 in the longitudinal direction (the side opposite to the corresponding one of the separate communication paths 26) in a state where the communication substrate 24 and the pressure-chamber-forming substrate 29 are joined to each other.

The nozzle plate 21 is a silicon or metal (for example, stainless steel) substrate that is joined to the lower surface of the communication substrate 24 (the surface on the opposite side to the pressure-chamber-forming substrate 29). The nozzles 22 are arranged in rows in the nozzle plate 21 of this embodiment. The nozzles 22 arranged in rows form nozzle rows that are arranged along the sub-scanning direction which is orthogonal to the main scanning direction at a pitch corresponding to the dot resolution.

The electronic device 14 of this embodiment has a multilayer body in which lamination constituent members are stacked and that functions as an actuator that causes a pressure change in the ink inside each of the pressure chambers 30. More specifically, as illustrated in FIG. 2, the pressure-chamber-forming substrate 29, a diaphragm 31, a piezoelectric element 32 (a type of driver element) and the sealing plate 33 are stacked as a unit and the electronic device 14 is formed.

The pressure-chamber-forming substrate 29 of this embodiment is formed of a silicon single-crystal substrate. In the pressure-chamber-forming substrate 29, spaces that are to become the pressure chambers 30 are formed by etching. Because the upper and lower surfaces of the pressure-chamber-forming substrate 29 are blocked by the diaphragm 31 and the communication substrate 24 these spaces respectively define the pressure chambers 30. Hereafter, these spaces are also referred to as the pressure chambers 30. The pressure chambers 30 are parallelly arranged in the pressure-chamber-forming substrate 29 so as to correspond to individual ones of the nozzles 22. Each of the pressure chambers 30 is a long space that extends in a direction orthogonal to the nozzle row direction, one end of which in the longitudinal direction communicates with a corresponding one of the separate communication paths 26 of the communication substrate 24 and the other end of which similarly communicates with a corresponding one of the nozzle communication paths 27 of the communication substrate 24. The ink introduced to the common liquid chambers 25 of the communication substrate 24 passes through each of the separate communication paths 26 and is supplied to the pressure chambers 30.

The diaphragm 31 is a thin-film-like member that has elasticity, and is formed on the upper surface of the pressure-chamber-forming substrate 29 (the surface on the opposite side to the communication substrate 24). The upper portion opening of the pressure chamber 30 is sealed by the diaphragm 31. A portion of the diaphragm 31 corresponding to the pressure chamber 30 functions as a deformable portion (or flexible surface) that deforms with the flexure of a drive portion (described later) of the piezoelectric element 32 in a direction away from a corresponding one of the nozzles 22 and in a direction toward a corresponding one of the nozzles 22. That is, a region of the diaphragm 31 corresponding to the upper portion opening of the pressure chamber 30 becomes a drive region where bending deformation is permitted in accordance with the driving of the piezoelectric element 32. In contrast, a region of the diaphragm 31 outside the upper portion opening of the pressure chamber 30 becomes a non-drive region where bending deformation is suppressed.

The diaphragm 31, for example, may be formed of an elastic film composed of silicon dioxide ($SiO_2$) formed on the upper surface of the pressure-chamber-forming substrate 29 and an insulating film composed of zirconia (zirconium oxide:$ZrO_2$) formed on the elastic film. Then, an active portion of the piezoelectric element 32 is stacked on the insulating film in the drive region corresponding to the upper portion opening of the pressure chamber 30. Below, this is suitably called the pressure-chamber-forming substrate 29 including the diaphragm 31. Moreover, the pressure-chamber-forming substrate 29 including the diaphragm 31 corresponds to the first substrate of the invention. Moreover, the surface of the diaphragm 31 on which the piezoelectric element 32 is formed corresponds to the first surface of the invention. Further, the pressure-chamber-forming substrate and the drive region (flexible surface) may be formed as a single body. That is, an etching process is performed from a lower surface side of the pressure-chamber-forming substrate, the pressure chamber is formed with a thin portion left on the upper surface side, and the thin portion may adopt a configuration in which it functions as the drive region. In the case of this configuration, the upper surface of the pressure-chamber-forming substrate corresponds to the first surface.

The piezoelectric elements 32 of this embodiment are so-called bending vibration mode piezoelectric elements. The piezoelectric elements 32 are, for example, each formed of a lower electrode layer, a piezoelectric layer and an upper electrode layer, which are not illustrated, stacked in order on the diaphragm 31. One of the electrodes among the upper and lower electrodes functions as a separate electrode for a corresponding one of the piezoelectric elements 32 and the other electrode functions as an electrode common to all the piezoelectric elements 32. Each of the piezoelectric elements 32 formed in this way, when subjected to an electric field corresponding to the electrode potential difference between the lower electrode layer and upper electrode layer, deforms in a direction away from a corresponding one of the nozzles 22 or in a direction toward a corresponding one of the nozzles 22. This flexibly changing portion functions as the drive portion of the piezoelectric element 32. As illustrated in FIG. 3, a lead electrode 35 that is electrically connected to the separate electrode of the piezoelectric element 32 and the lead electrode 35 that is connected to the common electrode extend to the top of the diaphragm 31 at a portion corresponding to the non-drive region extending across the upper portion opening rim of the pressure chamber 30. In this embodiment, in the middle of the lead electrode 35 in the non-drive region, a corresponding one of bump electrodes 40 projects toward the sealing plate 33 side. The bump electrode 40 is a contact point for connecting a drive circuit 46 of the sealing plate 33 and the lead electrode 35 of the piezoelectric elements 32 to each other. Further, the lead electrode 35 may be formed by extending the separate electrode and the common electrode of the piezoelectric element 32 (lower electrode layer and upper electrode layer) above the non-drive region or may be formed of a metal layer that is different from that used for the separate electrodes and common electrode. The lead electrode 35 of this embodiment is formed of, for example, gold (Au) or a gold alloy or the like.

The bump electrodes 40 are each formed of an internal resin portion (resin core) 41 that projects in a direction parallel to the pressure chamber (nozzle row direction) and a conductive film portion 42 that is formed partially on the surface of the internal resin portion 41. The internal resin portion 41 is, for example, composed of a resin that has elasticity such as a polyimide resin or the like and is formed in the non-drive region on the diaphragm 31. Moreover, the conductive film portion 42 is a portion of the lead electrode 35, has the same width as the lead electrode 35, and has an arch shape in cross section that conforms to the surface shape of the internal resin portion 41. The conductive film portion 42 is formed in a plurality along the nozzle row direction at positions that correspond to the lead electrode 35.

The sealing plate 33 (corresponding to the second substrate of the invention) is a plate formed of a silicon substrate having substantially the same size as the pressure-chamber-forming substrate 29. As illustrated in FIG. 3, the thickness T1 of the sealing plate 33 is smaller than the thickness T2 of the pressure-chamber-forming substrate 29 (including the diaphragm 31) serving as the first substrate. Because of this, the amount of heat transferred from the sealing plate 33 to joining resin portions 43 in a heating process during the main-curing process (mentioned later) becomes larger than the amount of heat transferred from the pressure-chamber-forming substrate 29 to the joining resin portions 43. Moreover, the thermal conductivity of the elastic film ($SiO_2$)

functioning as a portion of the diaphragm 31 and the insulating film ($ZrO_2$) in this embodiment is sufficiently lower than the thermal conductivity of silicon which is the material of the sealing plate 33 and the pressure-chamber-forming substrate 29. Because of this, the difference between the amount of heat transferred from the sealing plate 33 to the joining resin portions 43 in a heating process during the main-curing process and the amount of heat transferred from the pressure-chamber-forming substrate 29 to the joining resin portions 43 becomes larger.

The drive circuit 46 that performs driving of the piezoelectric element 32 is formed in the drive region of the sealing plate 33 of this embodiment that faces the piezoelectric element 32. The drive circuit 46 is formed by a semiconductor process on the surface of a silicon single-crystal substrate that becomes the sealing plate 33. Moreover, a wiring layer 47 that is to be joined to the drive circuit 46 is formed on the drive circuit 46 at the lower surface of the sealing plate 33, that is, a surface (corresponding to the second surface of the invention) on the piezoelectric element 32 side of the sealing plate 33 when being joined to the pressure-chamber-forming substrate 29. The wiring layer 47 is formed so as to be exposed to a surface of the sealing plate 33 that faces the diaphragm 31, that is, a surface to be joined to the diaphragm 31. The wiring layer 47 is located further toward the outside than the drive circuit 46 and is led around up to a position corresponding to the lead electrode 35 that extends to the non-drive region. Further, even though the wiring layer 47 is illustrated in FIG. 3 as one body for convenience, the wiring layer 47 contains a plurality of wires. Specifically, the wiring layer 47 corresponding to the lead electrode 35 for the separate electrode of the piezoelectric element 32 and the wiring layer 47 corresponding to the lead electrode 35 for the common electrode of the piezoelectric element 32 are patterned on the sealing plate 33 (the surface facing the pressure-chamber-forming substrate 29). The wiring layer 47 is electrically connected to a corresponding wire terminal in the drive circuit 46.

The pressure-chamber-forming substrate 29 having the diaphragm 31 and the piezoelectric element 32 stacked thereon and the sealing plate 33 are joined to each other by the joining resin portions 43 in a state where the bump electrode 40 is interposed between the joining resin portions 43. The joining resin portions 43 function as spacers that secure spaces between the neighboring substrates, function as sealing members that define spaces that house drive regions and the like between the neighboring substrates and seal such spaces, and function as an adhesive agent for joining the neighboring substrates. The joining resin portions 43 are composed of a photosensitive resin that is cured when irradiated by light. Moreover, the joining resin portions 43 in this embodiment are laminar structures formed of a ground layer 44 on the pressure-chamber-forming substrate 29 side and a main body layer 45 on the sealing plate 33 side. The joining resin portions 43 form a partition between the space that houses the drive region of the piezoelectric element 32 in a gap between the diaphragm 31 and the sealing plate 33 and an outer portion space. The ground layer 44 and the main body layer 45 are formed of the same material and as the material, a resin containing epoxy resin, acrylic resin, phenol resin, polyimide resin, silicone resin, styrene resin, or the like as the main component may be used as appropriate. In particular, from the viewpoint of chemical resistance, a material composed primarily of an epoxy resin is more preferable.

Moreover, as illustrated in FIGS. 3 and 4A to 4D, the joining resin portions 43 are formed along the nozzle row direction on both sides of the bump electrodes 40 that are arranged in a direction orthogonal to the nozzle row direction (or a direction parallel to the pressure chambers). A gap is formed between the diaphragm 31 and the sealing plate 33 as described above by the joining resin portions 43 (photosensitive resin portions) on both sides of the bump electrodes 40. This gap is set at a height (depth) such that deformation of the piezoelectric elements 32 is not impeded. Here, as illustrated in FIG. 3, the cross-sectional shape of the joining resin portions 43 in the width direction of the main body layer 45 (short side direction) is a reverse trapezoidal shape. That is the cross-sectional shape of the main body layer 45 is a reverse trapezoidal shape that has a narrow side (short side) on a side of the diaphragm 31 and a wide side (long side) on a side of the sealing plate 33. Because the thickness of the ground layer 44 is sufficiently smaller than the thickness of the main body layer 45, the joining resin portions 43 on the whole have a substantially reverse trapezoidal shape when the ground layer 44 and the main body layer 45 are joined together. Details regarding this point will be described later.

The joining resin portions 43 are patterned on the substrate through a photolithography process, that is, through processes such as coating onto substrates, pre-baking (pre-curing), exposure, development and post-baking (main-curing). In the electronic device 14 according to the invention, forming the joining resin portions 43 in a substantially reverse trapezoidal shape as described above contributes to the size reduction of the electronic device 14 while securing joining reliability. Below, the process for manufacturing the electronic device 14, specifically, the process for joining the pressure-chamber-forming substrate 29 serving as the first substrate on which the piezoelectric element 32 and the diaphragm 31 are stacked and the sealing plate 33 that serves as the second substrate is described. Further, the electronic device 14 of this embodiment is obtained by joining a silicon single-crystal substrate that has a plurality of regions that will each become the sealing plate 33 and a silicon single-crystal substrate that has a plurality of regions that will each become the pressure-chamber-forming substrate 29 that has the diaphragm 31 and the piezoelectric element 32 stacked thereon, and then cutting the joined structure into individual pieces.

Figure 4A:
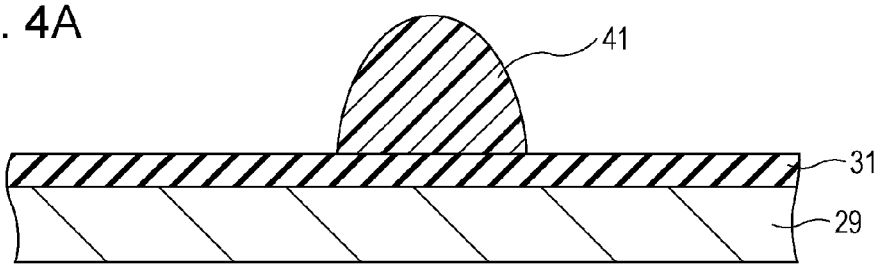
FIGS. 4A to 4D are schematic diagrams illustrating a process of manufacturing the electronic device.
Figure 4B:
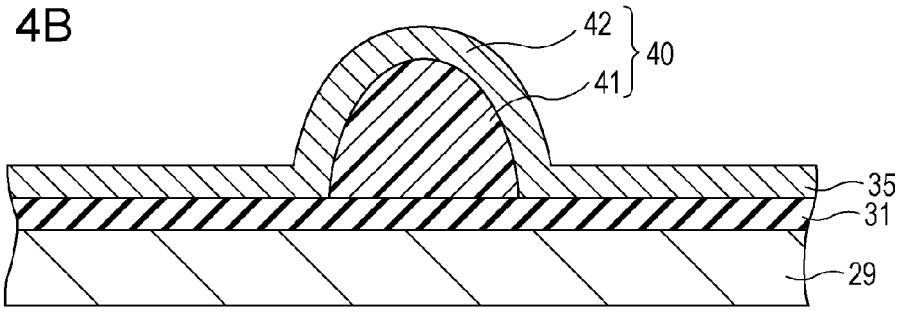

FIGS. 4A to 4D and 5A to 5C are schematic diagrams illustrating a process of manufacturing the electronic device 14, and illustrate the formation process in the vicinity of one of the bump electrodes 40 and the joining resin portions 43. At first, as illustrated in FIG. 4A, the diaphragm 31 is formed on the surface of the pressure-chamber-forming substrate 29 and, further, the internal resin portion 41 of the bump electrode 40 is formed in the non-drive region of the diaphragm 31. Specifically, after the resin, which is a material, is applied at a certain thickness, the internal resin portion 41 which projects from a certain position is patterned by a pre-baking process, a photolithography process, an etching process, and a post-baking process or the like. After the internal resin portion 41 has been formed, the lower electrode layer, the piezoelectric layer, the upper electrode layer, the lead electrode 35, the conductive film portion 42 and the like are sequentially stacked and patterned, and the piezoelectric element 32 is thereby formed. In the non-drive region on the diaphragm 31 of this embodiment, as illustrated in FIG. 4B, the lead electrode 35 is formed on the diaphragm 31, moreover, the conductive film portion 42 is formed on the internal resin portion 41 along the surface of the internal resin portion 41. Consequently, the bump electrode 40 is formed on the non-drive region on the diaphragm 31.

In contrast, on the sealing plate 33 side, firstly, the drive circuit 46 is formed on a surface of the sealing plate 33 to be joined to the pressure-chamber-forming substrate 29 (the diaphragm 31) by a semiconductor process. After the drive circuit 46 has been formed, and after a metal that is to become the wiring layer 47 has been coated on the joining surface of the sealing plate 33, the wiring layer 47 is patterned by a photolithography process and an etching process. Further, in this embodiment, as for a portion of the sealing plate 33 on which the wiring layer 47 has not been formed, the material of the silicon substrate is exposed. In order to increase the adhesive characteristics of the silicon substrate and the main body layer 45 that is to become the joining resin portions 43, a hexamethyldisilazane (HMDS) process is performed on the joining surface of the sealing plate 33 that is to be joined to the pressure-chamber-forming substrate 29.

Figure 4C:
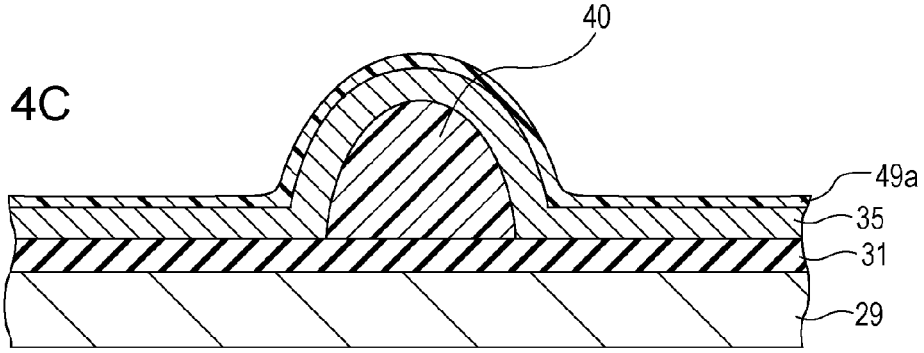
Figure 4D:
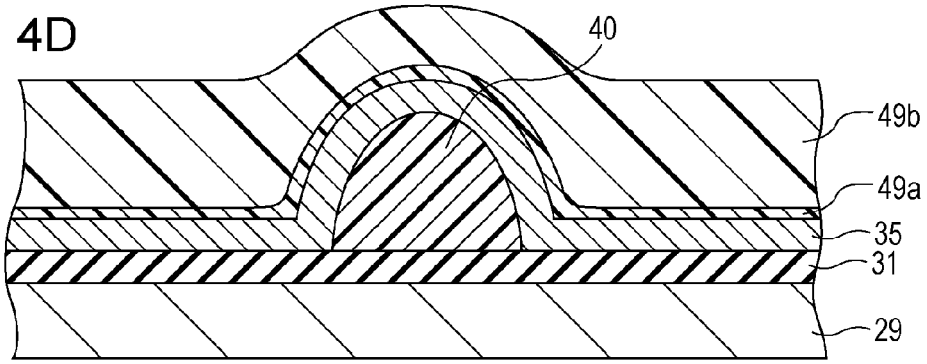

Next, a photosensitive resin material 49*a* of a first layer that is to become the ground layer 44 is applied to a surface (a joining surface on the sealing plate 33 side) of the diaphragm 31 stacked on the pressure-chamber-forming substrate 29. In this embodiment, as illustrated in FIG. 4C, on the diaphragm 31, in a state where the bump electrodes 40, the lead electrode 35 and the like are covered, the photosensitive resin material 49*a* of the first layer is applied relatively thinly by spin coating. Then, the photosensitive resin material 49*a* is cured by a heating process (first pre-curing process). Regarding the first pre-curing process, the degree of curing of a photosensitive resin material 49 is adjusted so as to be, for example, about 30% to 40% that at the time of main-curing. Similarly, as illustrated in FIG. 4D, a photosensitive resin material 49*b* of a second layer that is to become the main body layer 45 is applied on the photosensitive resin material 49*a* of the first layer (second application process).

Figure 5A:
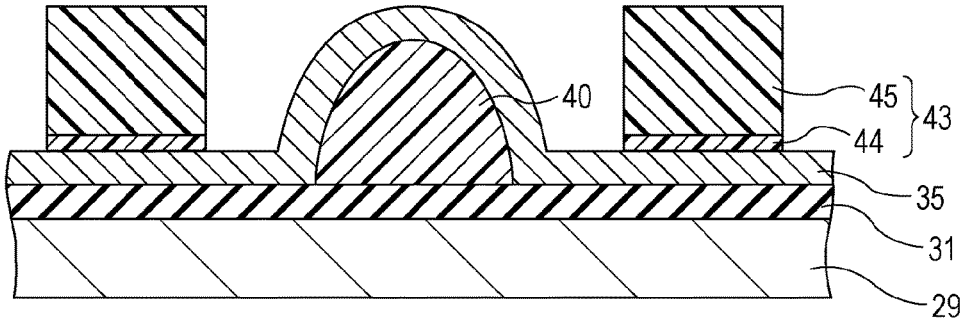
FIGS. 5A to 5C are schematic diagrams illustrating a process of manufacturing the electronic device.

After the photosensitive resin material 49*b* of the second layer has been applied, a second pre-curing process can be performed through a heating process. In this process, the degree of curing of the photosensitive resin material 49*b* of the second layer is adjusted so as to be, for example, about 50% to 60% that at the time of main-curing. Consequently, in a later patterning process, deformation of the shape of the main body layer 45 (the photosensitive resin material 49*b*) can be suppressed. However, the photosensitive resin material 49*a* of the first layer, via the first pre-curing process and the second pre-curing process, for example, is cured to a degree of 80% to 100% that at the time of main-curing. Consequently, in a later patterning process, deformation of the shape of the ground layer 44 (the photosensitive resin material 49*a*) and expansion at the time of joining can be suppressed, it is possible to form the ground layer 44 at a predetermined position with high precision. In a state where the photosensitive resin material 49*a* and the photosensitive resin material 49*b* have been pre-cured by the second pre-curing process, exposure and development are carried out, and the photosensitive resin material 49*a* and the photosensitive resin material 49*b* are patterned with a certain shape at a certain position (patterning process). In this embodiment, as illustrated in FIG. 5A, the ground layer 44 and the main body layer 45 in a ridge state (bank state) along the nozzle row direction press the region in which the bump electrode 40 is arranged on the diaphragm 31 and are patterned on both sides of the region. At this point in time, the cross-sectional shape of the joining resin portion 43 formed of the ground layer 44 and the main body layer 45 is substantially rectangular (a rectangle or a square).

Figure 5B:
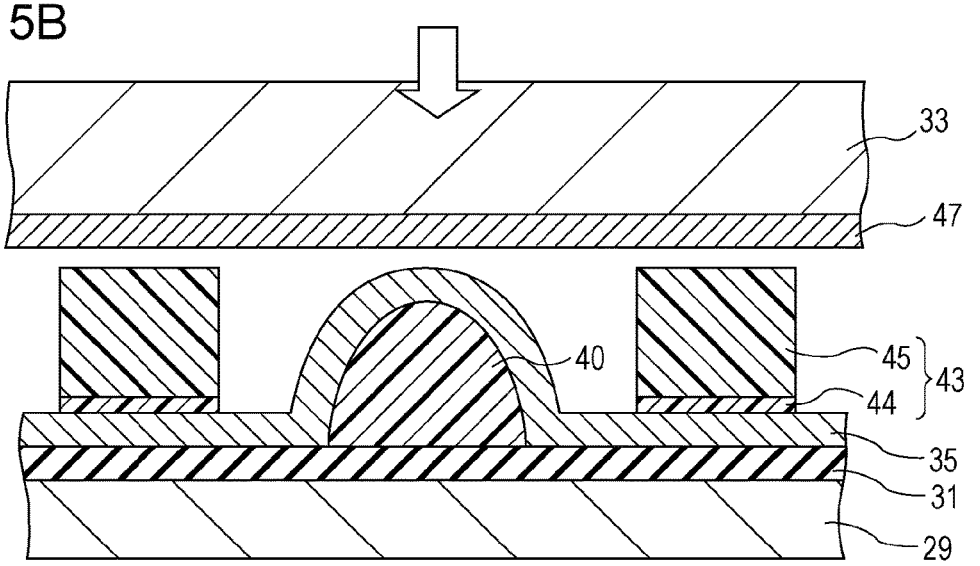
Figure 5C:
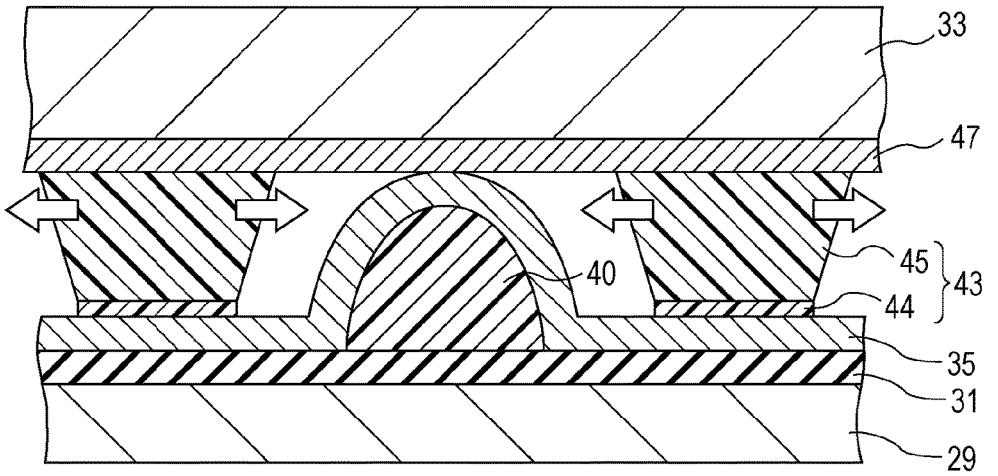

After the ground layer 44 and the main body layer 45 are formed on the pressure-chamber-forming substrate 29, the pressure-chamber-forming substrate 29 and the sealing plate 33 are joined to each other (joining process). Specifically, as illustrated in FIG. 5B, in a state where the relative positions of both of the silicon single-crystal substrates are aligned, both substrates are relatively moved in a direction toward each other and are stuck together with the bump electrode 40, the piezoelectric element 32 and the like interposed therebetween. Then, as illustrated in FIG. 5C, in a state where a force (load) is maintained in the direction in which the substrates press the joining resin portions 43 while resisting the elastic force of the bump electrodes 40 and the joining resin portions 43, the pressure-chamber-forming substrate 29 and the sealing plate 33 are each heated by a hot plate and the main-curing process (post-baking) is performed. In the main-curing process, the joining resin portions 43, by being heated from both sides via the pressure-chamber-forming substrate 29 and the sealing plate 33, are cured after the viscosity of the joining resin portions 43 (in particular, heated portion) has been temporarily decreased. Moreover, in this embodiment, the temperature of the hot plate that heats the pressure-chamber-forming substrate 29 side and the temperature of the hot plate that heats the sealing plates 33 side are set to be the same.

Here, as described above, because the thickness of the sealing plate 33 of this embodiment, is smaller than that of the pressure-chamber-forming substrate 29 that contains the diaphragm 31, the amount of heat transferred from the sealing plate 33 to the joining resin portions 43 (the main body layer 45) is larger than the amount of heat transferred from the pressure-chamber-forming substrate 29 to the joining resin portions 43 (mainly the ground layer 44). In addition, in this embodiment, the degree of curing of the main body layer 45 in the pre-curing process is lower than the degree of curing of the ground layer 44. Therefore, the joining resin portions 43 in the main curing process easily deform close to the sealing plates 33 as a result of having heat and a force (load) applied thereto. Specifically, as illustrated in FIG. 5C, it is difficult for the joining resin portions 43 to deform on the pressure-chamber-forming substrate 29 side whereas they easily deform close to the sealing plate 33. As a result, the cross-sectional shape of the joining resin portions 43 in the width direction (short side direction) of the main body layer 45 becomes a reverse trapezoidal shape and is cured while keeping this shape.

Through such processes, a spacer that secures a space between the sealing plate 33 and the pressure-chamber-forming substrate 29, a sealing plate that seals the space that houses the piezoelectric element 32 between both of the substrates, and the joining resin portions 43 that function as an adhesive agent that adheres both of the substrates together are formed. In this way, both of the substrates are joined by the joining resin portions 43 in a state where the bump electrode 40 on the lead electrode 35 side, and the wiring layer 47 of the sealing plate 33 are electrically connected to each other.

After both of the silicon single-crystal substrates have been joined to each other, with respect to the silicon single-crystal substrate of the pressure-chamber-forming substrate 29, the pressure chamber 30 is formed by performing a lapping process, a photolithography process, and an etching process. Finally, individual scribe lines are scribed in the silicon single-crystal substrate and individual ones of the electronic device 14 are cut. Further, in this embodiment, a structure formed by joining two silicon single-crystal substrates into a single piece is given as an example; however the structure is not limited to this. For example, the sealing plate and the pressure-chamber-forming substrate may first be diced into individual pieces and then joined to each other.

The electronic device 14 manufactured by the above-described process is positioned and fixed to the flow path unit 15 (the communication substrate 24) by using an adhesive agent or the like. Then, in a state where the electronic device 14 is housed in the housing space 17 of the head case 16, the recording head 3 is formed by joining the head case 16 and the flow path unit 15.

By using a configuration such as that described above, it is possible to achieve both the size reduction and high adhesive reliability of the electronic device 14. That is, by making the joining surfaces of the pressure-chamber-forming substrate 29 including the drive region and the joining resin portions 43 small, it is possible to arrange the joining resin portions 43 without interfering with the drive region even if space on the pressure-chamber-forming substrate 29 is limited. Consequently, it is possible to achieve size reduction and high densification of the electronic device 14. Moreover, because the joining surfaces of the sealing plate 33 and the joining resin portions 43 are larger than the joining surfaces of the pressure-chamber-forming substrate 29 and the joining resin portions 43 it is possible to secure adhesive reliability. Furthermore, because a space that houses the drive region and the like between the pressure-chamber-forming substrate 29 and the sealing plate 33 by using the joining resin portions 43 is defined, it is possible to flexibly adopt various types of layouts of the drive region in the electronic device 14.

Moreover, in this embodiment, because the thickness of the sealing plate 33 is smaller than that of the pressure-chamber-forming substrate 29, it is possible to realize a structure in which the joining surface of each of the joining resin portions 43 joined to the pressure-chamber-forming substrate 29 is smaller than the joining surface of each of the joining resin portions 43 joined to the sealing plate 33, namely, the joining surface of each of the joining resin portions 43 joined to the sealing plate 33 is larger than the joining surface of each of the joining resin portions 43 joined to the pressure-chamber-forming substrate 29. That is, it is possible to increase the amount of heat transferred from the pressure-chamber-forming substrate 29 to the joining resin portions 43 more than from the sealing plate 33 to the joining resin portions 43 in the main-curing process that cures the joining resin portions 43 while applying a load and heat to the pressure-chamber-forming substrate 29 and the sealing plate 33. Consequently, it becomes easier for the joining resin portions 43 to deform close to the sealing plate 33 side when softened temporarily in the process for curing the joining resin portions 43, and, as a result, the joining surface of each of the joining resin portions 43 joined to the sealing plate 33 is larger than the joining surface of each of the joining resin portions 43 joined to the pressure-chamber-forming substrate 29.

In this embodiment, as described above, the joining resin portions 43 are formed by stacking the ground layer 44 having a fixed width in the short side direction of the joining resin portions 43 and the main body layer 45 that widens toward the sealing plate 33 from the pressure-chamber-forming substrate 29 side; the ground layer 44 and the main body layer 45 having the same width. Then, the degree of curing of the photosensitive resin material 49*a* of the first layer on the pressure-chamber-forming substrate 29 side (the ground layer 44) is increased so as to be higher than that of the photosensitive resin material 49*b* of the second layer on the sealing plate 33 side at the time of the main-curing process by performing the first pre-curing process and the second pre-curing process. By doing this, deformation is suppressed when the load and heat are applied in the main-curing process, and the photosensitive resin material 49*a*, that is the ground layer 44, is formed precisely at a predetermined position on the pressure-chamber-forming substrate 29. As a result, it is possible to make the electronic device 14 smaller and finer. However, at the time of the main-curing process because the degree of curing of the photosensitive resin material 49*b* (the main body layer 45) of the second layer is lower than the degree of curing of the photosensitive resin material 49*a* (the ground layer 44) of the first layer, it is possible to secure adhesive characteristics for the sealing plate 33 and improve adhesive reliability.

Then, by installing the electronic device 14, it is possible to provide the recording head 3 and the printer 1 having a smaller size and high reliability.

Further, in the above-described embodiment, an example of the joining resin portions 43 formed by stacking the ground layer 44 and the main body layer 45 is given, however; the configuration is not limited to this, it is possible to adopt a configuration in which the ground layer 44 is not included. Even in this configuration, in the pre-curing process and the main-curing process, by making the amount of heat transferred from the sealing plate 33 to the joining resin portions 43 larger than the amount of heat transferred from the pressure-chamber-forming substrate 29 to the joining resin portions 43, it is possible to realize a configuration in which the joining surface of each of the joining resin portions 43 joined to the sealing plate 33 is larger than the joining surface of each of the joining resin portions 43 joined to the pressure-chamber-forming substrate 29.

Moreover, in the above-described embodiment, an example of a configuration is given in which the temperature of the hot plate that performs heating on the pressure-chamber-forming substrate 29 side and the temperature of the hotplate that performs heating on the sealing plate 33 side are set to be the same; however, the configuration is not limited to this and it is possible to adopt a configuration in which the amount of heat transferred from the sealing plate 33 to the joining resin portions 43 is increased more than the amount of heat transferred from the pressure-chamber-forming substrate 29 to the joining resin portions 43 in the main-curing process by setting the temperature of the hot-plate that heats on the pressure-chamber-forming substrate 29 side to be higher.

Moreover, in the patterning process for the photosensitive resin material, by making the direction normal to the surface of the applied photosensitive adhesive and the direction of light incident on the surface of the photosensitive adhesive at the time of exposure inclined with respect to each other, it is possible to form the joining resin portions 43 in the shape of a trapezoid having the long side on a side of the sealing plate 33 and the narrow side on a side of the diaphragm 31 in cross section.

Furthermore, in each of the above-described embodiments, as the electronic device 14 according to the invention, a configuration in which ink, which is a type of liquid, is caused to be ejected from nozzles by driving the piezoelectric elements 32 serving as driver elements is given as an example, however; the configuration is not limited to this, as long as there is the electronic device 14 in which the first substrate and the second substrate are joined together by a joining resin portion serving as a photosensitive resin, the invention can be applied. For example, the invention can be applied to an electronic device used in a sensor that detects vibration, displacement or the like by using a driver element.

Moreover, in the above description, as the liquid ejecting head, an ink jet type recording head mounted in an ink jet printer was given as an example, however, it is possible to use a liquid ejecting head that ejects a liquid other than ink. For example, it is possible to apply the invention to a color material ejection head used for the manufacture of color filters such as those of liquid crystal displays, an ejection head used in the manufacture of electrode structures such as those of an organic electroluminescence (EL) display, a field emission display (FED), a bioorganic substance ejecting head used in the manufacture of biochips or the like.

What is claimed is:

1. An electronic device comprising:

a first substrate that has a drive region in a first surface, and a second substrate that has a second surface that is joined to the first surface by a joining resin portion composed of a photosensitive resin, wherein a space that houses the drive region is defined between the first surface and the second surface by the joining resin portion, and a joining surface of the joining resin portion joined to the first surface is smaller than a joining surface of the joining resin portion joined to the second surface.

2. The electronic device according to claim 1, wherein the joining resin portion has a trapezoidal shape in which, in a cross section obtained in a short side direction, a side of the first surface is a narrow side and a side of the second surface is a long side.

3. The electronic device according to claim 1, wherein a thickness of the second substrate is smaller than a thickness of the first substrate.

4. A liquid ejecting head including the electronic device according to claim 1, wherein by driving the drive region by using a piezoelectric element, a pressure change is produced in a liquid in a pressure chamber formed in the first substrate and the liquid is caused to be ejected from a nozzle via the pressure chamber by using the pressure change.

5. A liquid ejecting head including the electronic device according to claim 2, wherein by driving the drive region by using a piezoelectric element, a pressure change is produced in a liquid in a pressure chamber formed in the first substrate and the liquid is caused to be ejected from a nozzle via the pressure chamber by using the pressure change.

6. A liquid ejecting head including the electronic device according to claim 3, wherein by driving the drive region by using a piezoelectric element, a pressure change is produced in a liquid in a pressure chamber formed in the first substrate and the liquid is caused to be ejected from a nozzle via the pressure chamber by using the pressure change.

7. A method of manufacturing an electronic device that includes a first substrate that has a drive region in a first surface and a second substrate that has a second surface that is joined to the first surface by a joining resin portion composed of a photosensitive resin, wherein a space that houses the drive region is defined between the first surface and the second surface by the joining resin portion, the method comprising:

applying a photosensitive resin material that becomes the joining resin portion on the first surface of the first substrate, pre-curing the photosensitive resin material by heating, patterning the photosensitive resin material through exposure and development, joining the first substrate and the second substrate while the photosensitive resin material is interposed between the first surface and the second surface, and main-curing the joining resin portion by heating while a force is maintained in a direction in which the first substrate and the second substrate press the joining resin portion, wherein an amount of heat transferred from the second substrate to the joining resin portion during the main-curing is larger than an amount of heat transferred from the first substrate to the joining resin portion.

8. The method of manufacturing an electronic device according to claim 7, wherein the applying includes a first application of a first photosensitive resin material that becomes the joining resin portion to the first surface and a second application of a second photosensitive resin material that becomes the joining resin portion to the first photosensitive resin material so as to be stacked on the first photosensitive resin material, and the pre-curing includes a first pre-curing of the first photosensitive resin material after the first application has been performed and a second pre-curing of the first photosensitive resin material and the second photosensitive resin material after the second application has been performed.

* * * * *